United States Patent [19]

Hedin

[11] 4,109,245

[45] Aug. 22, 1978

[54] PROGRAMMABLE ELECTRONIC SIGN

[76] Inventor: Robert A. Hedin, 41272 Village Lake Rd., Novi, Mich. 48050

[21] Appl. No.: 658,484

[22] Filed: Feb. 17, 1976

[51] Int. Cl.[2] ..... G09F 9/32

[52] U.S. Cl. ..... 340/334; 340/336

[58] Field of Search ..... 340/334, 339, 336

[56] References Cited

U.S. PATENT DOCUMENTS

| | | | |
|---|---|---|---|
| 2,290,261 | 7/1942 | Welch | 340/336 |
| 2,481,269 | 9/1949 | Welch | 340/339 |
| 2,519,993 | 8/1950 | Allen | 340/336 |
| 3,081,450 | 3/1963 | Sinninger | 340/336 |
| 3,555,351 | 1/1971 | Sherwin et al. | 340/339 |
| 3,579,226 | 5/1971 | Strehlow | 340/339 |
| 3,638,217 | 1/1972 | Sutherland | 340/336 |
| 3,750,138 | 7/1973 | Burgan et al. | 340/334 |

*Primary Examiner*—David L. Trafton
*Attorney, Agent, or Firm*—Roger A. Marrs

[57] ABSTRACT

In an electronic sign having a set of segmented character displays, programming cards are used to control which segments are illuminated. In one embodiment, each card has a printed circuit providing electrical connection from an unfiltered, rectified ac power source via a silicon controlled rectifier to those display segments for which there are corresponding contacts in the printed circuit. Plural such cards may be wired to each character display via respective SCR's with segmented trigger signals causing sequential card energization and hence message display.

In another embodiment, segment illumination data is stored in a memory and accessed sequentially and repetitively to control which characters are displayed. Similar programming cards may be used to enter into the memory data defining each message character. A set of counters control memory addressing and selective segment energization via appropriate decoder/driver circuits that receive the data from the memory and drive the display segments.

5 Claims, 5 Drawing Figures

PROGRAMMABLE ELECTRONIC SIGN

BACKGROUND OF THE INVENTION

1. Field of the Invention

The present invention relates to programmable electronic signs, and particularly to such signs wherein segmented character displays are controlled by character selection cards or memory-stored data that specify which display segments are to be illuminated.

2. Description of the Prior Art

Electronic signs in which several different messages are displayed sequentially have gained widespread acceptance because they are so effective in attracting the attention of prospective customers. Typically such signs have one or more rows of individual character displays each of which can exhibit any letter of the alphabet, any numeral, or certain symbols such as a hyphen, percent sign, etc. By appropriate wiring or programming means, the sign can be made to display any word, message or sequence of messages.

A principal shortcoming of prior art electronic signs is their complexity and hence high cost. One object of the present invention is to provide a low cost electronic sign which though simple in design nevertheless permits user selection and modification of each displayed message, and which can sequentially display a plurality of such messages.

The individual character displays used in electronic signs typically comprise a matrix of lamps that are selectively illuminated to produce the desired character. Recently other alphanumeric display configurations have come into vogue, such as the 16-segment display having sixteen separate rectilinear and diagonal segments.

In most prior art signs, character information specifying the desired messages was stored in an alphanumeric code format such as the ASCII code. Complex decoding was required to convert this alphanumeric code into drive signals to energized the requisite display segments that produce the corresponding character. A memory capable of storing such multi-bit alphanumeric codes was required. Entry of new messages necessitated coding into this format. Thus, in certain systems it was necessary to prepare a punched tape containing the new message, and to use a tape reader to enter this data into the memory. In contrast, it is another object of the present invention to provide an electronic sign in which message data is stored and handled directly in the form of segment illumination data bits. That is, instead of storing the ASCII or other conventional alphanumeric code, each character is stored as a set of bits each of which specifies whether a corresponding display segment is to be energized. Data storage, decoding and display drive requirements thereby are substantially simplified.

A further object of the present invention is to provide an inexpensive means for entering a new message. Keyboard and encoding systems, or punched tape assemblies of the prior art, are costly. Although they provide considerable speed and possibly simplify altering the message content, they are not acceptable for low cost displays. In contrast, the present invention uses a set of printed circuit programming cards associated with respective alphanumeric characters. The message is chosen by inserting appropriate ones of these cards having the desired message characters. By coding these cards directly with segment illumination data, system simplicity and low cost is achieved.

SUMMARY OF THE INVENTION

These and other objectives are achieved in the present invention in which message character information is handled exclusively in the form of segment illumination data. In this format, each data bit specifies whether a corresponding display segment is to be energized.

In a first embodiment, individual programming cards each contain a printed circuit conforming to the segment illumination data for a particular alphanumeric character. The card for a desired character is inserted into a socket wired in the power path to the associated character display. Power thus is supplied via the programming card printed circuit only to the display segments that produce the corresponding character. The message can be changed merely by inserting a new group of cards.

In another embodiment, a memory is used to store the segment illumination data for a plurality of messages. Each data bit is stored in a separate memory location which has an address corresponding to the message sequence, character display, and specific display segment to which that bit is allocated. To display the message, the memory is accessed sequentially and the memory access address is used to enable the segment drive circuitry associated with each accessed data bit. By periodically changing the message sequence portion of the memory address, different sets of data are accessed, resulting in sequential display of different messages. Simple means are provided for loading new data into the memory using, e.g., printed circuit programming cards of the type described above.

BRIEF DESCRIPTION OF THE DRAWINGS

A detailed description of the invention will be made with reference to the accompanying drawings, wherein like numerals designate corresponding parts in the several figures.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention best is defined by the appended claims.

Operational characteristics attributed to forms of the invention first described also shall be attributed to forms later described, unless such characteristics obviously are inapplicable or unless specific exception is made.

Figure 1:
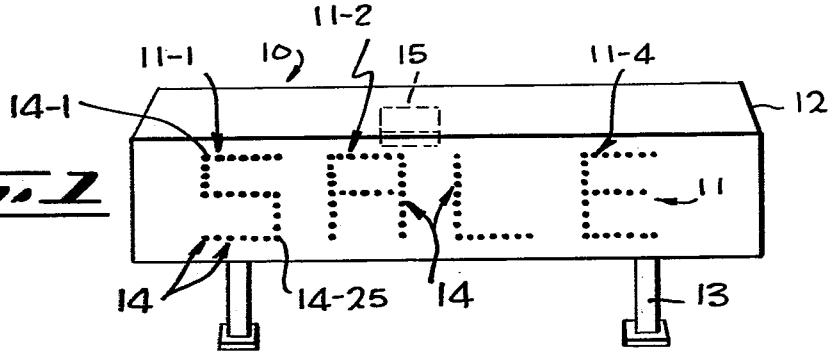
FIG. 1 is a pictorial view of an electronic sign incorporating the present invention.

In the illustrative embodiment of FIG. 1, the inventive electronic sign 10 has four character displays 11-1 through 11-4. These are mounted at the front of a housing 12 supported by legs 13. Each character display 11 typically comprises a 5 × 5 matrix of 25 lamps, such as the lamps 14-1 through 14-25 in the display 11-1. Electronic circuitry 15, such as that shown in FIG. 2, causes certain of the lamps 14 in the displays 11 to be illuminated so as to display a message such as the word "SALE" shown in FIG. 1. At certain time intervals, the circuitry 15 causes other lamps 14 to be illuminated so that a sequence of messages is displayed by the sign 10. For example, the words "SALE," "BUY," "NOW," and "SAVE" may be displayed sequentially.

Figure 2:
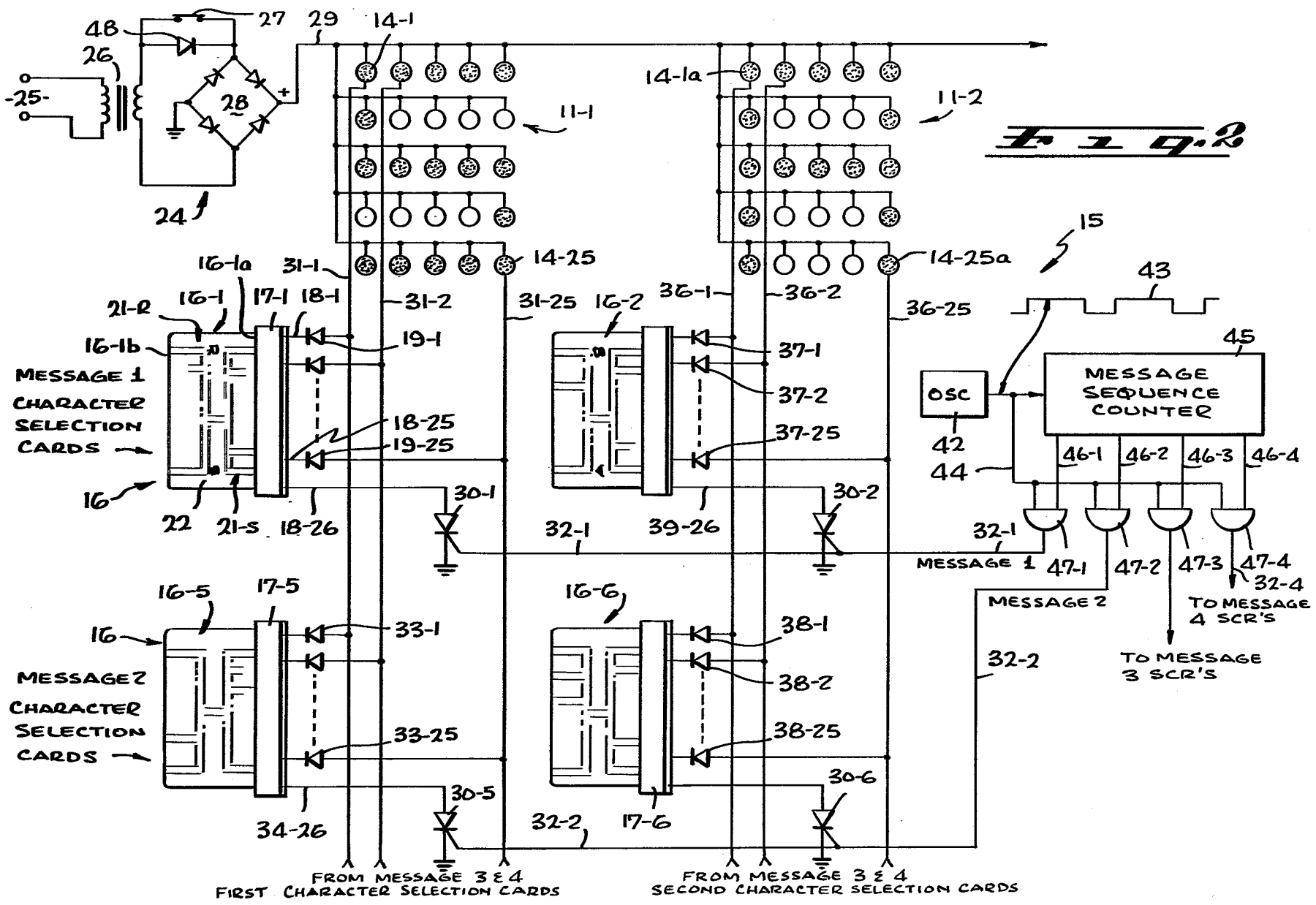
FIG. 2 is an electrical diagram of one embodiment of the inventive electronic sign employing printed circuit programming cards for message selection.

In the embodiment of FIG. 2, the messages that are displayed sequentially on the sign 10 are programmed using printed circuit character selection cards 16-1 through 16-*n* that control illumination of the displays 11. There is one such programming card 16 for each character in every message in the sequence. Thus for the first message exemplified by the word "SALE," four cards are employed, two of which (designated 16-1 and 16-2) are shown in FIG. 2. Four separate cards are used for the second message, including the cards 16-5 and 16-6 shown in FIG. 2.

The programming card configuration is typified by the card 16-1 which is received by a socket 17-1. In this embodiment, the socket 17-1 has 26 electrical contacts 18-1 through 18-26. The contacts 18-1 through 18-25 are wired via respective diodes 19-1 through 19-25 to the respective lamps 14-1 through 14-25 in the character display 11-1. The socket contact 18-26 is wired to a power source return described below.

The card 16-1 has two printed circuits 21-R and 21-S formed on a rigid, electrically insulating substrate 22. The circuit 21-S is configured so that when the edge 16-1*a* of the card 16-1 is inserted into the socket 17-1, an electrical path will be completed between the contact 18-26 and those specific other contacts 18-1 through 18-25 associated only with the lamps 14 that are to be illuminated in the display 11-1 to produce the character "S." When power is supplied via the contact 18-26 only these lamps will light up, producing the desired character.

The second circuit 21-R on the card 16-1 is configured to produce a display of the letter "R." Thus if the card edge 16-1*b* were inserted into the socket 17-1, the requisite lamps 14 would be illuminated to produce the character R when a power connection is completed via the contact 18-26.

Thus it can be seen that any character can be produced on an individual display 11 by selection of the appropriate programming card 16. In the embodiment of FIG. 2, for each message in the display sequence there is a socket 17 corresponding to every display 11. Thus for the first message there are four sockets, of which the first two 17-1 and 17-2 are shown in FIG. 2. Similarly, for the second message there are four sockets of which the first two 17-5 and 17-6 are illustrated.

Typically a set of programming cards would be supplied with the sign 10. To change the message sequence, the user would select cards producing the desired characters and insert these into the sockets 17 to produce the desired message. In the illustrative example of FIGS. 1 and 2, the cards 16-1 and 16-2 inserted in the sockets 17-1 and 17-2 are selected to produce the first two letters "S" and "A" of the first message "SALE". Similarly, the cards 16-5 and 16-6 inserted respectively in sockets 17-5 and 17-6 bear the letters "B" and "U" from the second message "BUY."

Still referring to FIG. 2, unfiltered, rectified ac power is supplied to the displays 11 by a circuit 24. An ac source is connected via terminals 25 to a transformer 26 the secondary of which is connected via a normally closed switch 27 to a rectifier bridge 28. Full wave rectification is achieved, and the unfiltered dc output is supplied to all of the lamps 14 via a common positive buss 29.

The power return path for the lamps 14 in each display 11 is through one of the programming cards 16 and a silicon controlled rectifier (SCR) 30 associated therewith. For example, each of the lamps 14-1 through 14-25 in the first display 11-1 is connected via a respective line 31-1 through 31-25 to the respective diode 19-1 through 19-25. The common contact 18-26 of the socket 17-1 is connected to ground via an SCR 30-1. When this SCR 30-1 is triggered on by a signal on a line 32-1, a conduction path is completed from the positive voltage buss 29 via the circuit 21-S on the card 16-1 and via the SCR 30-1 so as to provide power to those lamps forming the character "S" in the display 11-1.

The power supplied by the circuit 24 is unfiltered rectified ac, so that when the trigger signal on the line 32-1 is removed, the SCR 30-1 will turn-off at the end of the next ac half cycle.

The lines 31-1 through 31-25 also are connected via diodes 33-1 through 33-25 to the socket 17-5. The common contact 34-26 of the socket 17-5 is connected to ground via an SCR 30-5 that is triggered by a signal on a line 32-2. Thus when the signal on the line 32-1 is low but a high signal is provided on the line 32-2, the SCR 30-5 will conduct, so that power is provided to the display 11-1 via the card 16-5. In the embodiment shown, this causes the character "B" to be displayed. Similarly, the lines 31-1 through 31-25 are connected to other sockets (not shown) associated with the character selection cards for the third and fourth messages.

A similar arrangement is provided for each of the other character displays 11-2 through 11-4. Thus the lamps 14-1*a* through 14-25*a* in the display 11-2 are connected to lines 36-1 through 36-25. The socket 17-2 is connected to these lines via the diodes 37-1 through 37-25, and the socket 17-6 is connected via the diodes 38-1 through 38-25. SCR's 30-2 and 30-6 are associated respectively with the common terminals 39-26 and 40-26 of the sockets 17-2 and 17-6. The SCR 30-2 is turned on by the trigger signal on the line 32-1, so that the card 16-2 controls character selection of the display 11-2 during the first message. Similarly, the SCR 30-6 is turned on by the trigger signal on the line 32-2 so that the card 16-6 controls character selection for the display 11-2 during the second message.

Sequential message display is controlled by an oscillator 42 (FIG. 2) that provides a rectangular wave signal 43 on a line 44. The signal 43 increments a counter 45 which counts repetitively from "1" to "4," and provides corresponding count outputs on lines 46-1 through 46-4. These outputs are supplied to respective AND-gates 47-1 through 47-4 which supply the SCR trigger signals on respective lines 32-1 through 32-4. These trigger signals are produced in sequence, so that the four messages are displayed sequentially on the sign 10.

Since the AND-gates 47-1 through 47-4 are enabled by the signal 43, these gates will be disabled when the signal 43 is low. At such times, none of the SCR's 30 will be triggered on and no characters will be displayed on the sign 10. Advantageously the oscillator 42 is adjusted to provide a signal 43 that is on (i.e., high) for say 2 seconds, and off for say ½ second. With this arrangement, each message will be displayed for 2 seconds, and the sign 10 will be dark for ½ second between each message.

In the power supply 24, a diode 48 is connected between the transformer 26 and the rectifier bridge 28. When the switch 27 is open, the effect of the diode 48 is to cause half-wave rectification rather than full wave rectification. As a result, a lower average voltage is supplied on the line 29 and the lamps 14 do not light up so brightly. Thus, the switch 27 is a "dimmer" switch which, when opened, will cause the sign 10 to be dimmed. Although not illustrated, an electronic switching device could be used in place of the switch 27 and controlled by the message counter 45. In this way, the sign 10 automatically can be switched between a bright and a dim condition.

Figure 3:
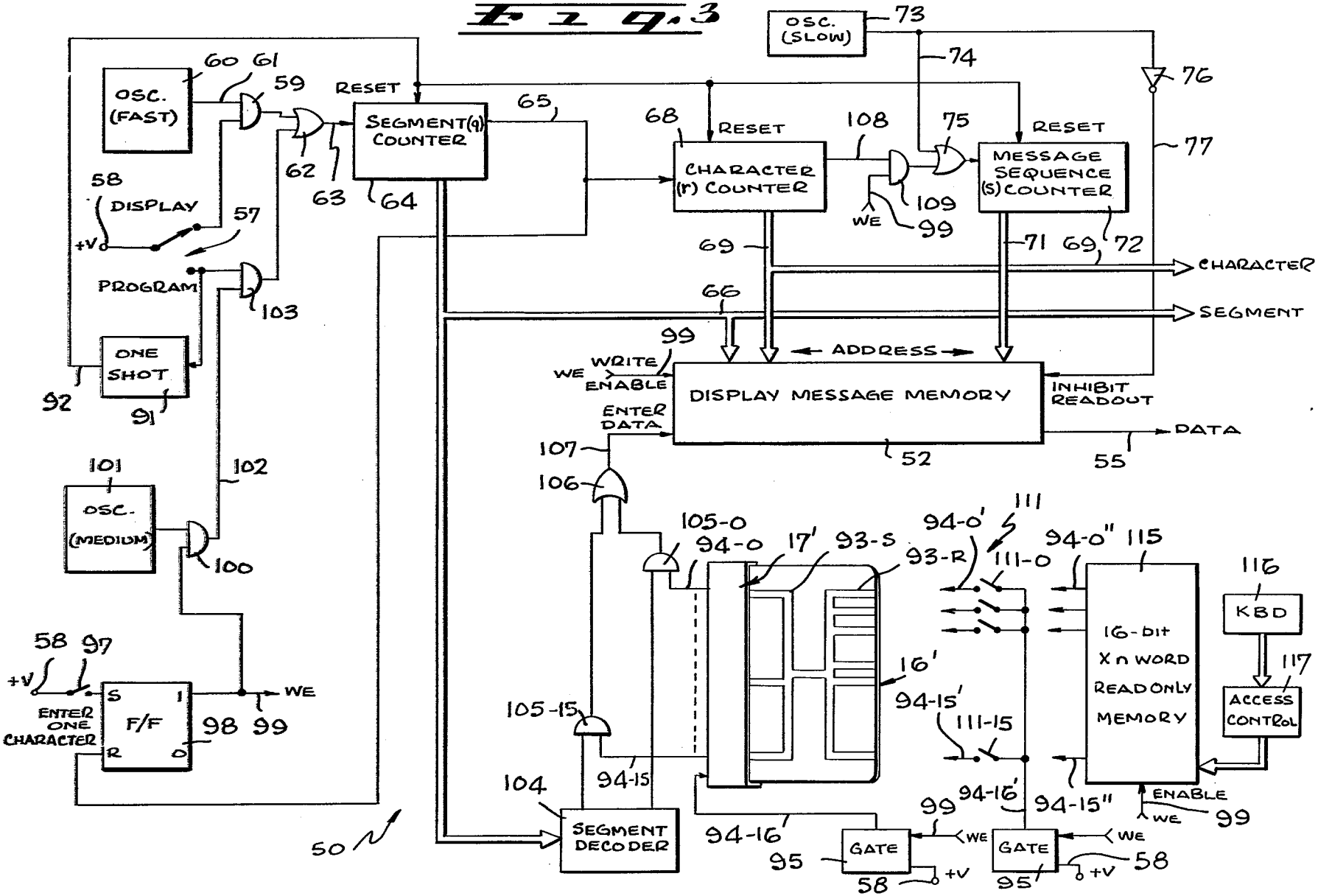
FIGS. 3 and 4 together form an electrical block diagram of another embodiment of the inventive electronic sign employing memory storage of plural, sequentially displayed messages.
Figure 4:
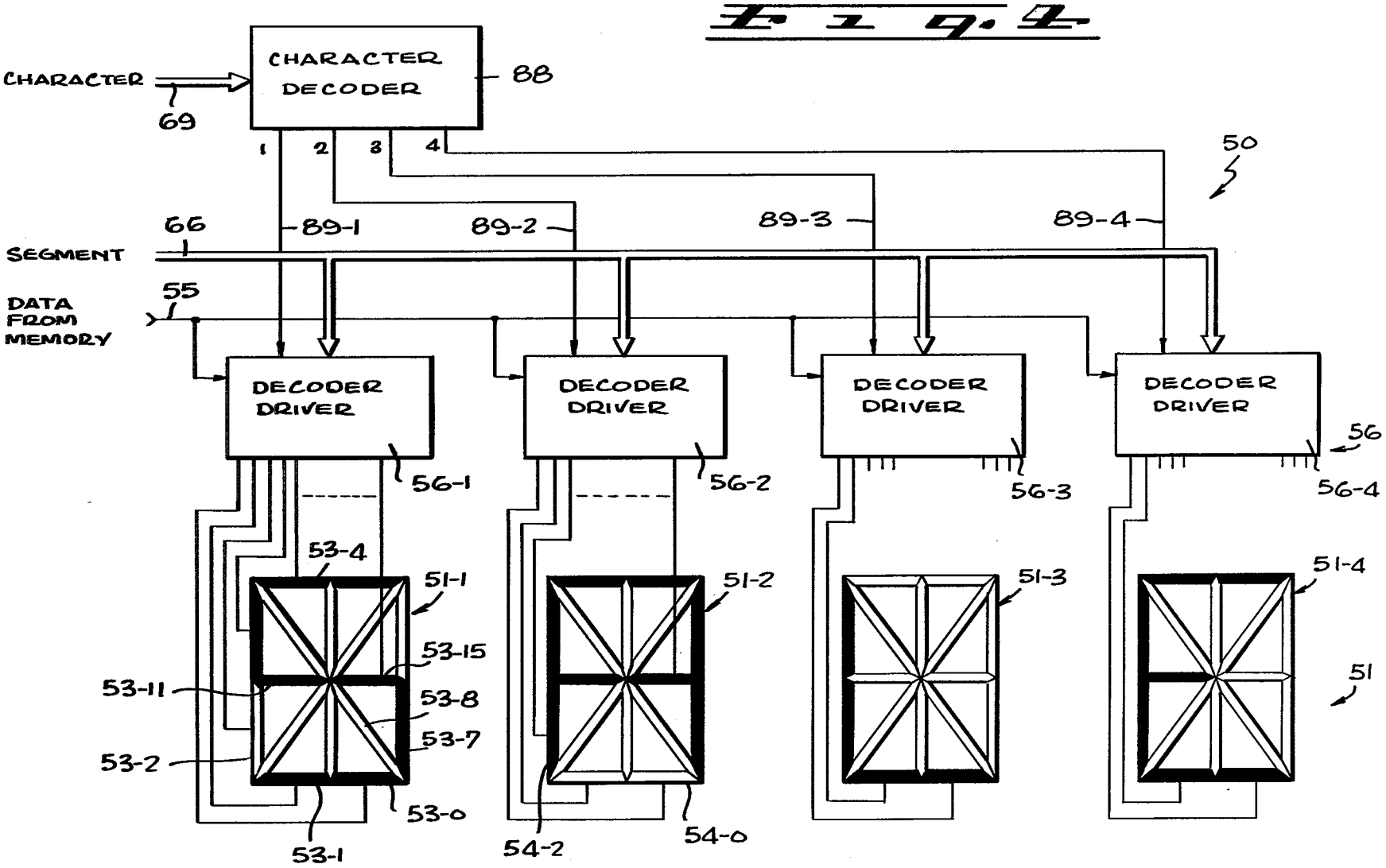

The sign 50 of FIGS. 3 and 4 employs a set of 16-segment character displays 51. Four such displays 51–1 through 51–4 are shown in FIG. 4 with certain segments "illuminated" to form the message "SALE." As in the sign 10, the sign 50 may be programmed to display sequentially a set of user-selected messages.

Data defining the messages to be displayed is stored in a memory 52 (FIG. 3). The data is stored in sets of sixteen bits that specify which of the corresponding sixteen segments in a particular character display 51 are to be illuminated. For example, the binary code 1000100010111011 will cause illumination of the appropriate one of segments 53–0 through 53–15 (FIG. 4) to produce the character "S".

Advantageously, the memory 52 has a number N of storage locations given by $$N = Q \times R \times S$$

where $Q$ is the number of segments in each display 51 (herein $Q=16$), where $R$ is the number of character displays in the sign 50, and $S$ is the number of messages in the message sequence. Each storage location in the memory 52 has a corresponding binary-coded address in which the low order bits specify segment ($q$), the next higher order bits specify character ($r$), and the highest order bits specify message sequence ($s$).

Each location in the memory 52 stores a single data bit that specifies whether the segment identified by the address of that storage location is to be illuminated. For example, in the first message ($s=0$), if the second character ($r=1$) is the letter A, then the first segment ($q=0$) corresponding to the segment 54–0 in FIG. 4 is off. Thus the data bit stored at the corresponding address [$s=0$, $r=1$, $q=0$] will be a binary "0." Since the segment 54–2 is illuminated, the corresponding data bit at the storage location [$s=0$, $r=1$, $q=2$] will be a binary "1."

With this arrangement, for a sign having R = 16 character displays 51, each with Q=16 segments, and with a capability of displaying S=16 sequential messages, the memory 52 would have 1024 memory locations. It could be implemented using an integrated circuit semi-conductor memory such as the Intel Corporation type 2102 MOS 1 bit by 1024 address memory.

To produce the desired sequential message display, the memory 52 is read out repetitively, and the output data, supplied via a line 55, is used to control a set of decoder/drivers 56 that supply power to the displays 51. Read-out occurs when a switch 57 is in the "display" position shown in FIG. 3. A positive voltage from a terminal 58 enables an AND-gate 59 to supply clock pulses from an oscillator 60 via a line 61 and an OR-gate 62 to the increment input 63 of a binary counter 64. The counter 64 advantageously is of modulo $Q$ that is, it resets to zero each $Q$ counts. An output pulse is supplied on a line 65 each time this resetting occurs. The contents of the counter 64 represents the segment address $q$, and this is provided to the memory 52 and elsewhere via a buss 66. For a system having 16-segment character displays 51, the bus 66 provides a 4-bit binary number.

Each time the counter 64 counts to $Q$, the signal on the line 65 is provided to another binary counter 68 the contents of which designate the character $r$. Advantageously, the counter 68 is of modulo $R$, so that it resets to zero and begins counting again each time it has reached a count equal to the number of displays 51 in the sign 50. The contents of the counter 68, representing the character $r$ portion of the memory 52 address is supplied via a buss 69.

The message sequence $s$ portion of the memory 52 address is supplied in parallel-binary format on a buss 71 from a message sequence counter 72. The counter 72 advantageously is of modulo $S$, and is incremented by a rectangular wave signal (like that designated 43 in FIG. 2) provided from an oscillator 73 via a line 74 and an OR-gate 75. The rate of the oscillator 73 is considerably slower than the oscillator 60. Each message in the sequence is displayed by the sign 50 during the period of time that the oscillator 73 output signal is high. When this signal goes low, an inverter 76 provides a high signal on a line 77 that inhibits readout of data from the memory 52. As a result, when the oscillator 73 output is low, no message is displayed by the sign 50.

During the display of any individual message in the sequence, the contents of the counter 72 remains constant. However, during this time the segment data for all of the character displays is read out repetitively and sequentially under control of the fast oscillator 60, the segment counter 64 and the character counter 68. The scan rate is sufficiently rapid so that even though the display segments are energized sequentially, to the eye the characters appear to go on simultaneously.

Figure 5:
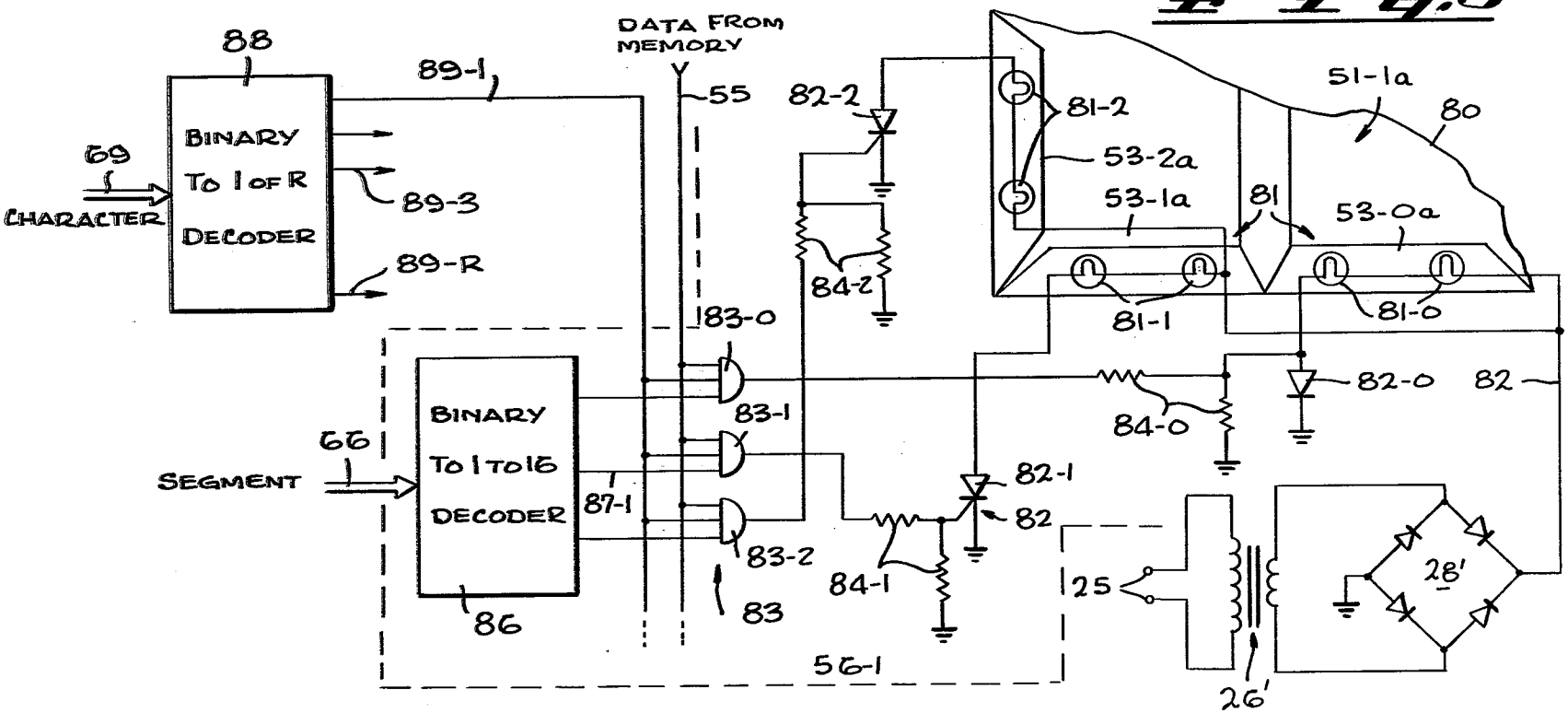
FIG. 5 is an electrical schematic diagram showing illustrative decoder/driver circuitry employed in the system of FIGS. 3 and 4.

The manner in which the segments are energized is illustrated in FIGS. 4 and 5. In the embodiment of FIG. 5 each segment of the character display 51–1*a* consists of a transparent or translucent opening of appropriate shape in a panel 80. Three such openings are designated 53–0*a*, 53–1*a* and 53–2*a* in FIG. 5. Respective pairs of lamps 81–0, 81–1 and 81–2 are situated behind these openings. All of these lamps 81 are connected to a positive voltage buss which supplies unfiltered, rectified ac voltage from a transformer 26' and a rectifier bridge 28'.

Each decoder/driver 56 includes a silicon controlled rectifier 83 associated with each pair of lamps 81. Thus in the illustrative decoder/driver 56–1 of FIG. 5, the power supply return connection to the lamps 81–0 through 81–2 is via the respective SCR's 82–0 through 82–2. Trigger signals to these SCR's 82–0 through 82–2 are supplied from respective AND-gates 83–0 through 83–2 via respective resistor pairs 84–0 through 84–2. Each of the AND-gates 83–0 through 83–2, as well as the other AND-gates (not shown) associated with the other remaining segments of the display 51–1*a*, receives the segment data from the memory 52 via the line 55. Each is enabled by a respective output signal from a binary to 1 of 16 decoder 86 which receives the segment code in binary form the buss 66. Thus, e.g., if the segment code is $q=1$ so that the binary code present on the buss 66 is 0001, the decoder 86 will provide a high output only on the line 87-1 to enable only the AND-gate 83-1. No other output lines of the decoder 86 will have a high signal, so that no other AND-gate 83 will be enabled.

Each of the decoder/drivers 56 is configured like the circuit 56-1 of FIG. 5 and each receives the segment code on the buss 66 and the memory data on the line 55. However, only one decoder/driver 56 is enabled at a time, namely the one identified by the character code on the buss 69. The decoder 88 provides a corresponding enable signal via a respective one of the lines 89-1 through 89-R. As can be seen in FIG. 5, the decoder 88 comprises a binary to 1 of R decoder that produces a high output only on the one line 89 corresponding to the received binary character code. Thus if the code $r=0$ is received, an output occurs on the line 89-1 that enables all of the AND-gates 83 in the decoder/driver 56-1.

Sixteen segment illumination data bits are accessed from the memory 52 for the first character display 51-1 and first message. These are read from memory locations $s=0$, $r=0$, $q=0$ through 15. Since the character code is $s=0$, the line 89-1 is high and the AND-gates 83 (FIG. 5) are enabled. As each segment data bit is accessed, the AND-gate 83 for the corresponding segment is enabled by the output from the decoder 86. Thus for the first segment code $q=0$, the AND-gate 83-0 is enabled. If the segment illumination data bit on the line 55 is a "1," the AND-gate 83-0 produces a high output that triggers on the SCR 82-0, causing the lamps 81-0 to illuminate the segment 53-0*a*.

Upon occurrance of the next pulse from the oscillator 60, the AND-gate 83-1 is enabled, since the segment code is $q=1$. If the corresponding data bit is a "1," the SCR 82-1 is triggered on to illuminate the segment 53-1*a*; if the data bit is a "0," the AND-gate 83-1 provides no trigger pulse and the segment 53-1*a* remains dark.

The requisite SCR's 83 thus are triggered on sequentially at a fast rate established by the oscillator 60. Each SCR 83 that is turned on remains conducting until the end of the half cycle of the ac supplied to the rectifier bridge 28' when the unfiltered rectified ac voltage on the line 82 drops sufficiently toward ground potential to turn off the SCR. However, since the segment and character counters 64 and 68 recycle rapidly, causing repetitive readout of the memory 52, the same requisite SCR's 83 again will be triggered near the beginning of the next ac half cycle. The appearance to the eye is that the character displays 51 are continuously illuminated while each message is displayed.

Between messages, when data readout from the memory 52 is inhibited by the signal on the line 77, none of the SCR's 82 in any decoder/driver 56 are triggered, so that the displays 51 all are off. For the next message, the sequence address ($s$) will have been incremented, and sequential, repetitive readout from the memory 52 of the next set of segment illumination data causes the next message to be displayed. Although not shown, for certain messages (i.e., certain values of $s$), segment illumination data may be provided from a time and/or temperature display circuit instead of from the memory 52.

The messages displayed by the sign 50 may be changed by altering the contents of the memory 52 using the circuitry shown in FIG. 3. To this end, the switch 57 is set to the "PROGRAM" position so that the AND-gate 59 is disabled. When the switch 57 is so set, a monostable multivibrator (one-shot) 91 provides a signal on a line 92 that resets the segment, character and message sequence counters 64, 68 and 72 to zero.

Each new message is inserted one character at a time. The specific character is selected using a programming card 16' similar to the programming card 16 of FIG. 2, but arranged to control a 16-segment display 51. For example, the card 16' may have two printed circuits 93-R and 93-S, configured to produce respectively the characters "R" and "S." The card 16' is received by a socket 17' having 16 contacts 94-0 through 94-15 associated with respective segment data addresses $q = 0$ through $q = 15$. The socket 17' also has a common contact 94-16 to which a positive dc voltage is supplied from a terminal $+v$ via a gate 95.

To enter the first character in a new message, the desired character card 16' is inserted in the socket 17' and an "enter one character" switch 97 momentarily is closed. This causes a flip-flop 98 to be set to the "1" state so as to produce a high "WE" write enable signal on a line 99. This signal is supplied to the memory 52 wherein it enables the entry of new data into the storage locations specified by the addresses supplied on the busses 66, 69 and 71.

The "WE" signal enables the gate 95, and also enables an AND-gate 100 which passes clock pulses from a medium rate oscillator 101 to a line 102. These pulses thence are supplied via an AND-gate 103, enabled when the switch 57 is in the "PROGRAM" position, and via the OR-gate 62 to the segment counter 64. This counter 64 begins to count. The corresponding segment address ($q$) is decoded by a binary to 1 of 16 decoder 104. That circuit enables a corresponding one of a set of AND-gates 105-0 through 105-15 associated with the respective socket 17 contacts 94-0 through 94-15. The outputs from all of the AND-gates 105-0 through 105-15 are supplied via an OR-gate 106 to the data entry terminal 107 of the memory 52.

With this arrangement, as the segment counter 64 is incremented, successive data bits are entered into the memory 52. Whether each bit is a binary "1" or "0" is determined by the corresponding segment of the circuit 93-S on the card 16'. For example, if the first segment illumination data bit is a "1," a circuit will be provided from the contact 94-16 via the card 16' to the contact 94-0. Thus when the segment code $q = 0$, the AND-gate 105-0 will provide a high output which is supplied via the OR-gate 106 to the data entry terminal 107 of the memory 52. The data bit will be entered into the $q = 0$ position, for the specific character and message sequence indicated by the contents of the counters 68 and 72.

When the sixteen data bits for the selected character have been entered, the segment counter 64 will reset to zero. When this occurs, the output signal on the line 65 will increment the character counter 68 in preparation for entry of the next character. The signal on the line 65 also will reset the flip-flop 98 so as to terminate the "WE" signal on the line 99. This will inhibit data entry into the memory 52, and by disabling the AND-gate 100 will prevent further incrementing of the segment counter 64. The card 16' then is replaced by another card corresponding to the next desired character. When the new card 16' has been inserted in the socket 17', the "enter one character" switch 97 again momentarily is depressed. As before, this will cause entry of the corresponding sixteen segment illumination data bits, into the positions associated with the character specified by the counter 68. In this manner, characters are entered sequentially for the entire message.

When the character counter 68 resets, a signal is provided on a line 108 to increment the message sequence counter 72. To this end, the signal on the line 108 is fed via an AND-gate 109 enabled by the "WE" signal on the line 99 and via the OR-gate 75 to the increment input of the counter 72. Although not illustrated, provision could be made to increment the counters 68 and 72 manually, as by pushbutton or switch selection, so as to allow the entry of a single character into any desired character and message sequence location in the memory 52.

As an alternative, the programming cards 16′ may be replaced by a set of switches 111–0 through 111–15 connected between the line 94–16′ and the respective lines 94–0′ through 94–15′. Each such switch 111 corresponds to a respective segment in a display 51, and accordingly character selection is made by closing those switches associated with the segments that are to be illuminated.

As yet another alternative, the card 16′ may be replaced with a read only memory 115 containing a set of 16-bit codes corresponding to the segment illumination data for all possible characters. The desired character is selected on a keyboard 116 which causes a control circuit 117 to access from the memory 115 the desired 16-bit word, which is provided on the lines 94–0″ through 94–15″. These lines are connected to the AND-gates 105–0 through 105–15 so as to supply the accessed data to the memory 52 serially under control of the segment counter 64 and the segment decoder 104.

Intending to claim all novel, useful and unobvious features shown or described, the inventor claims:

1. A programmable electronic sign, comprising: a set of individual character displays mounted in alignment to form a sign, each display having a plurality of illuminable segments which when selectively energized form an image of a selected character;

a corresponding set of selectable programming cards each associated with a respective one of said displays, each card containing indicia designating the specific segments to be illuminated in the associated display to produce on that display a character defined by that card;

means utilizing said set of programming cards and interconnected with said displays for energizing in each display only the segments specified by the associated program card, each display thereby containing an illuminated image of the defined character, the characters together forming a selected message;

each of said programming cards contains a printed circuit having conductive strips corresponding to display segments to be illuminated, and wherein said means for energizing comprises;

a respective socket for receiving and making electrical contact to each programming card in said set, a power source, and electrical interconnection means for connecting power from said source to each of said displays via the associated programming card and socket, so that for each display only the segments corresponding to said conductive strips in the associated programming card printed circuit are energized;

said power source comprises rectifier means providing unfiltered, rectified ac power and wherein said electrical interconnection means includes a silicon controlled rectifier in circuit with each programming card, so that power is supplied to the display segments via that silicon controlled rectifier and the associated programming card printed circuit, and trigger means for providing a trigger signal to said silicon controlled rectifiers for substantially the entire duration of time that the characters selected by said programming cards are to be displayed, said silicon controlled rectifiers going off at the end of the ac half cycle next following termination of said trigger signal as said unfiltered power approaches ground potential;

each of said displays comprises an $n \times m$ matrix of lamps, wherein said programming card printed circuit has a common contact and $(n \times m)$ other contact locations, said circuit having a conductive path extending from said common contact to those contact loctions corresponding to display segments to be illuminated, wherein said common contact is connected via said socket to a silicon controlled rectifier, all of the other contact locations being connected via said socket to respective segments of the associated display, a source of unfiltered, rectified ac power connected to all of said segments, said silicon controlled rectifier being in the return path to said source, so that when said silicon controlled rectifier is switched on, a power connection is completed via said silicon controlled rectifier, said common contact, and said programming card printed circuit to said corresponding display segments, and trigger means for providing a trigger signal to turn on said silicon controlled rectifier for a duration of time during which said display is to be illuminated, said silicon controlled rectifier being turned off after termination of said trigger signal the next time that said unfiltered power approaches ground potential.

2. An electronic sign according to claim 1 wherein several sets of programming cards are similarly connected to said displays, each such set of cards defining a separate message in a sequence of messages to be produced on said sign, there being a corresponding set of similarly connected silicon controlled rectifiers for each set of programming cards, and wherein said trigger means provides trigger signals sequentially to each set of silicon controlled rectifiers so that the corresponding sets of programming cards sequentially control illumination of said display segments to produces said sequence of messages on said sign.

3. An electronic sign according to claim 2 wherein said trigger means comprises;

an oscillator producing a rectangular wave signal, a counter incremented by said rectangular wave signal, said counter producing sequential outputs in accordance with the contents thereof, and plural gates, each enabled by a respective output of said counter and by said rectangular wave signal from said oscillator, said trigger signals being providing sequentially from respective ones of said gates, each trigger signal only being provided during the on portion of the duty cycle of said rectangular wave signal.

4. An electronic sign according to claim 1 wherein each programming card contains two printed circuits corresponding to two different characters, said card being configured to be received by said socket in either of two different orientations that respectively make electrical contact to one and the other of said two printed circuits.

5. An electronic sign according to claim 1 wherein said utilizing means comprises;

a memory, data entry means for interrogating said programming card indicia and for entering into said memory sets of segment illumination data bits each indicating whether a particular display segment is to be illuminated for a certain character said sets of bits corresponding to said programming card indicia, and means for accessing from said memory said data bits and for controlling illumination of said display segments in response to said accessed data.

* * * * *